United States Patent [19]

Bauer

[11] Patent Number: 5,058,522

[45] **Date of Patent: * Oct. 22, 1991**

[54] PORTABLE PERSONAL FLOATATION DEVICE

[76] Inventor: Martin G. Bauer, 3039 State St., Bismarck, N. Dak. 58501

[ * ] Notice: The portion of the term of this patent subsequent to May 22, 2007 has been disclaimed.

[21] Appl. No.: 526,294

[22] Filed: May 21, 1990

Related U.S. Application Data

[63] Continuation of Ser. No. 234,898, Aug. 22, 1988, Pat. No. 4,926,781.

[51] Int. Cl.[5] ..... B63C 9/10

[52] U.S. Cl. ..... 114/351; 114/283; 114/357; 440/26; 440/27; 441/130

[58] Field of Search ..... 114/61, 351, 357, 283; 440/26, 27, 28, 29, 71, 72, 90; 441/106, 86, 119, 129, 130, 131

[56] References Cited

U.S. PATENT DOCUMENTS

| | | | |
|---|---|---|---|
| 299,951 | 6/1884 | Brown . | |
| 315,297 | 4/1885 | Kenly . | |
| 660,504 | 10/1900 | German . | |
| 1,053,472 | 2/1913 | Boatright . | |
| 1,567,555 | 12/1925 | Straussler . | |
| 1,657,786 | 1/1928 | Carmichael . | |
| 2,317,905 | 4/1943 | Galkin | 440/26 |
| 2,332,009 | 10/1943 | Perri | 440/26 |
| 2,674,753 | 4/1954 | Wood | 441/130 |
| 2,747,204 | 5/1956 | Erickson et al. | 9/5 |
| 2,803,837 | 8/1957 | Virobik | 9/5 |
| 2,894,270 | 7/1959 | Manthos | 9/17 |
| 2,946,068 | 7/1960 | Jasper | 441/130 |
| 2,975,749 | 3/1961 | Armstrong | 115/22.2 |
| 3,045,636 | 7/1962 | Thomas et al. | 440/26 |
| 3,123,840 | 3/1964 | Cefalo, Jr. | 9/2 |
| 3,198,274 | 8/1965 | Cocksedge | 180/7 |
| 3,324,488 | 6/1967 | Schulz, Jr. | 9/1 |
| 3,471,875 | 10/1969 | Lyon | 9/2 |
| 3,477,074 | 11/1969 | Bezanis | 9/11 |
| 3,704,472 | 12/1972 | Huey, Jr. | 9/5 |
| 3,732,587 | 5/1973 | Fletcher | 9/6 |
| 3,955,230 | 5/1976 | Rogers et al. | 9/347 |
| 4,315,475 | 2/1982 | Echols | 114/61 |
| 4,869,195 | 9/1989 | Eichfeld | 114/255 |
| 4,894,033 | 1/1990 | Chang | 440/27 |
| 4,926,781 | 5/1990 | Bauer | 114/351 |

*Primary Examiner*—Sherman Basinger
*Assistant Examiner*—Thomas J. Brahan
*Attorney, Agent, or Firm*—Kinney & Lange

[57] ABSTRACT

A portable personal floatation device for water sports such as fishing and the like is constructed of a light material such as styrofoam and has a main cross panel with an opening for a user to fit through so the floatation device surrounds the user. The device is designed to be easily accessible for the user, with a door provided on a side panel. The central opening in the main panel of the device accommodates the occupant to carry the device and wade into the water, and as the device begins to float, the occupant may sit on the main panel of the device.

8 Claims, 5 Drawing Sheets

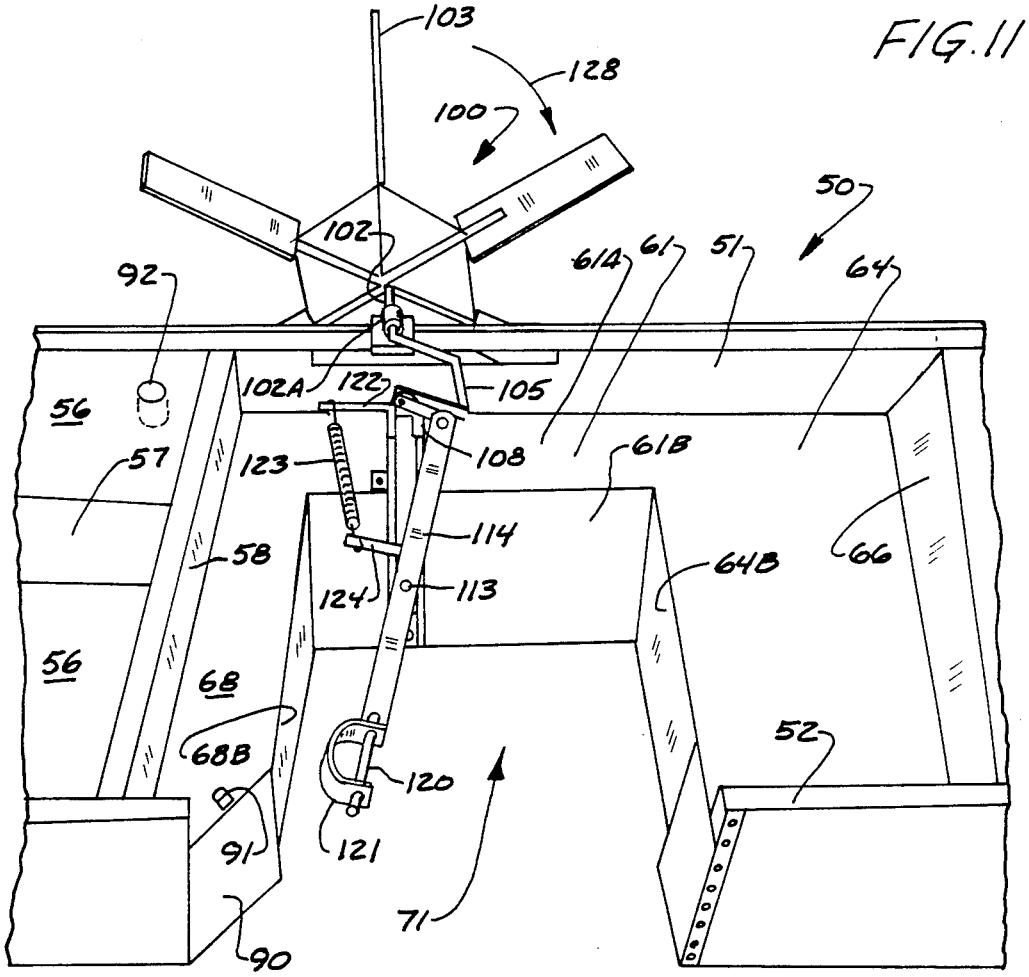
FIG. 11
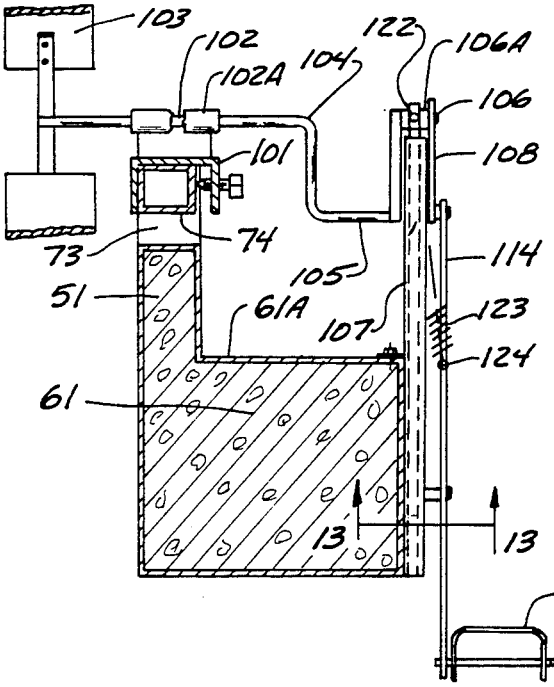
FIG. 12
FIG. 13
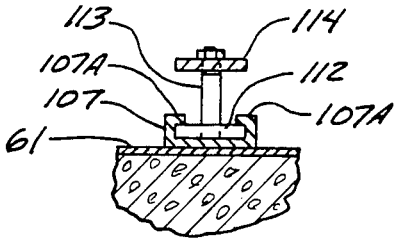

PORTABLE PERSONAL FLOATATION DEVICE

CROSS REFERENCE TO RELATED APPLICATION

This application is a continuation-in-part of my copending application Ser. No. 07/234,898, filed Aug. 22, 1988, now U.S. Pat. No. 4,926,781 for Portable Personal Floatation Device.

BACKGROUND OF THE INVENTION

This invention pertains to a portable personal floatation device for recreational water sports such as fishing and the like.

An assortment of portable watercraft have been introduced in the prior art to provide recreational vehicles for sportsmen. Several variations on an innertube float or toroidial buoy have been disclosed in U.S. Pat. Nos. 2,674,753: 3,123,840: and 3,324,488. U.S. Pat. No. 2,674,753 shows a manually operated boat with a floatation ring designed to carry a single occupant with legs extending through the bottom of the boat for propelling the craft through the water. However, this device does not permit easy access into the boat, or a means to exit from the boat while in the water. This patent does not provide a mount for a small motor.

Another floatation device using a ring around the occupant's body is presented in U.S. Pat. No. 3,324,488. This device also does not provide a door or easy access to the opening through the boat. In much the same way, the Cefalo, Jr. U.S. Pat. No. 3,123,840 discloses a portable collapsible one-person boat employing an innertube-shaped buoy which can be attached to a motor. All three of these portable boats with innertube floatation systems are not designed to be easily accessible.

Lyon U.S. Pat. No. 3,471,875 shows a portable fishing float with a rectangular hull and an adjustable chair. While this device is adapted to be portable, it is not designed to allow the user to carry the boat into the water while in it. This device is not adapted for use with the motor, and is not easily accessible in deep water.

U.S. Pat. No. 2,332,009 granted to Perri shows a float having a frame with hinged sides and two inflatable pontoons. While this device is designed to be collapsed when not in use, it is not constructed to allow the user to walk into the water with the boat around the user, and is not easily accessible in shallow water.

A catamaran is disclosed in Echols U.S. Pat. No. 4,315,475. It is collapsible, and adaptable to be used with a motor. This design shows a chair suspended above two pontoon floats, as opposed to a device which can be used while wading. The catamaran is not accessible by a door, and can not be carried about the user while walking into the water.

Another type of watercraft using floats, and designed to be operated by one person is disclosed in U.S. Pat. No. 1,567,555. This device is used for swimming, and is not adapted to be used for fishing, which requires a sturdier frame to leave the occupant free for sports.

A hammock canoe is shown in Brown U.S. Pat. No. 299,951. This boat has a central opening to allow the occupant to walk into the water and begin floating once the boat and user have reached deep water. This device is not designed, however, to allow easy access by door, and is not adapted for the use of a motor, or for sports which require a sturdy frame and easy control of the craft.

SUMMARY OF THE INVENTION

A portable personal floatation device or boat has a pair of pontoon-like side floats at the forward portion joined together at the rear with a top main panel which has a central opening in which a user can stand. A door is provided in one of the two side floats for easy access. The rear portion of the boat is a float block that extends across the width of the floatation device at the rear. The occupant is accommodated in the central opening of the top main panel. The floats extend from the top surfaces or panels downwardly to support the main center panel surface slightly above the water level when supporting the weight of the occupant. The occupant carries the device into the water while standing in the opening. When the device is floating on the water, the user sits on the rear float with legs extending into the water through the opening. When the occupant would like to exit the floatation device, for example when the water is waist deep, the side door provides an easy egress (or access) instead of jumping over the side of the float which can be difficult and dangerous.

The frame is adapted to allow an outboard motor to be attached. The side walls or panels have longitudinally extending integral handles to allow the user to lift and hold the boat while wading into the water. The relatively light weight of the device, approximately in the range of 35 to 40 pounds, allows the user to carry the device easily while it is in place around the waist.

Safety straps are removably connected across the opening defined by the first panel, and are preferably positioned between the user's legs to stop the user from falling all of the way through into the water in case of an accidental slip into a deep hole while wading. While the safety straps do not constrict movement while the user has their feet through the center opening, to wade or paddle the boat, they are adapted to provide a reliable means of stopping the occupant from falling all the way through the center opening.

The door for accessing the opening defined in the floatation device or boat has a latch for securing it in a closed position. A foot support bar is supported between the spaced side floats at the front of the opening in the main panel. Also, a protective screen may be used to keep the user's feet from contact with the motor or propeller if such is used.

Adjustable stand-in footrests hang below the boat into the water. At least one footrest hangs by rope fasteners of suitable length, and the ropes are attached to the first main panel of the floatation device. The use of adjustable ropes for the footrest allows the user to adapt the length of the rope for comfort.

The floats, including the side pontoon-like portion and the rear cross float block of the personal floatation device are preferably constructed from a buoyant material, such as styrofoam, to create a light yet durable watercraft. The styrofoam can be formed in any desired manner and can have a reinforcing skin of aluminum or fiberglass over the styrofoam.

BRIEF DESCRIPTION OF THE DRAWINGS

FIG. 11 is a perspective view of a modified paddlewheel drive used with the present invention;

FIG. 12 is a sectional view taken immediately ahead of the modified paddle wheel drive mechanism shown in FIG. 9; and FIG. 13 is a sectional view taken as on line 13—13 in FIG. 12 showing a slide mechanism used with the drive of FIG. 9.

DETAILED DESCRIPTION OF THE PREFERRED EMBODIMENTS

Figure 1:
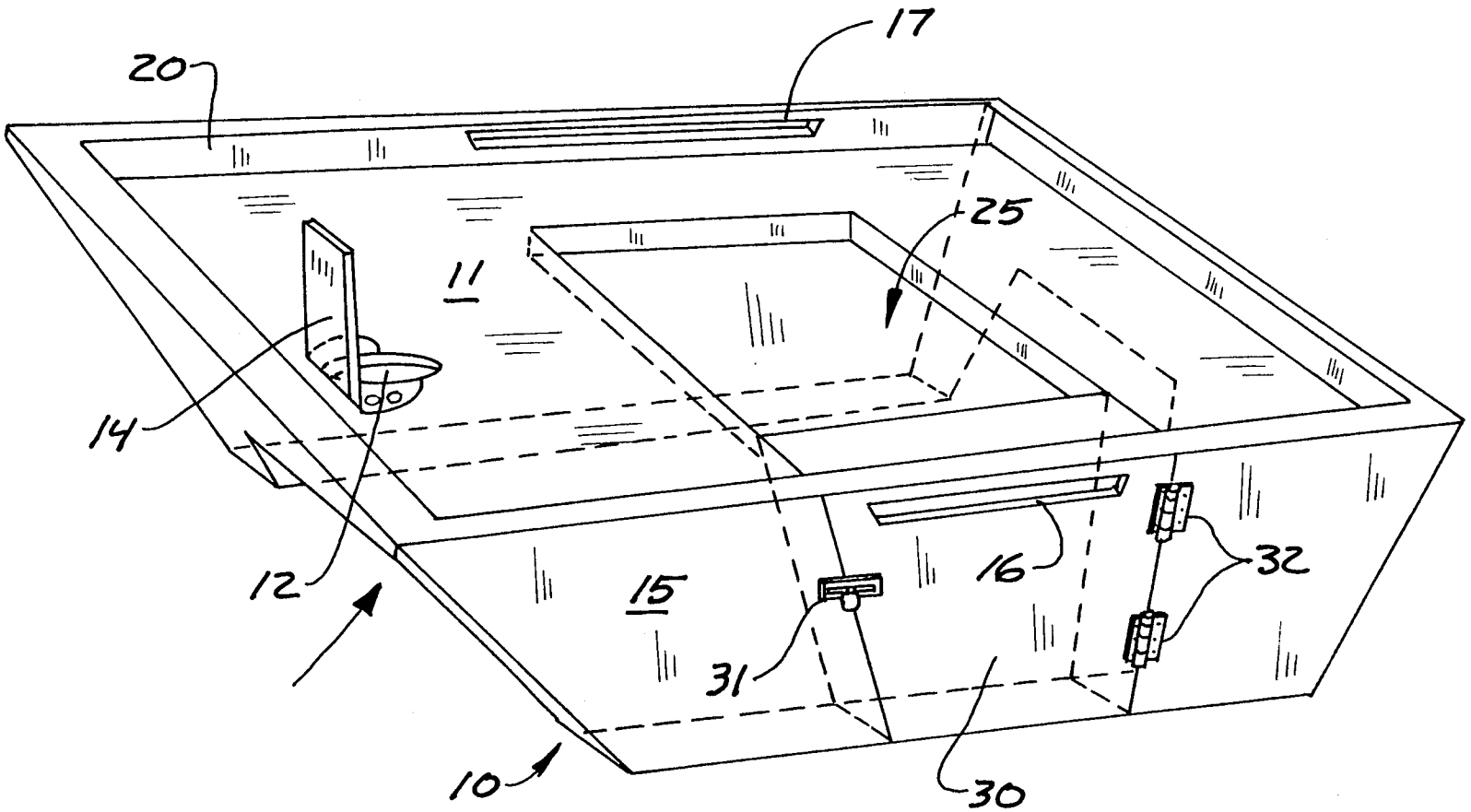
FIG. 1 is a perspective view of a portable personal floatation device or boat made according to the present invention.

As shown in the drawings, at FIG. 1, a portable personal floatation device indicated generally at 10 comprises a frame including a first main generally horizontal panel 11 and vertical side panels 15 and 20 which are in the form of relatively wide pontoons that extend below the main panel and which are spaced apart to form a central channel 24 between them. The first main panel 11 has a central opening shown generally at 25, which is of the size to accommodate a user.

As seen in FIG. 1, the side panel 15 has a door 30 cut therein which is mounted on hinges 32 on one edge so that it can swing open, and permit the user to easily step into the opening 25 when the device is to be used. The door swings out from the side panel 15 and can be secured in a closed position by a latch 31. The side panels have narrow upper rims 15A and 20A and a handle 16 is formed in the rim above panel 15 and side panel 20 has a handle 17. These handles 16 and 17 are to carry the personal flotation device 10 while the user stands in the opening 25 and wades into the water.

The personal flotation device 10 is to be lifted by the handles 16 and 17 while the user is standing in the opening 25, allowing the person in the opening to walk into the water with the float around them for easy portage. While the user is carrying the float, the door 30 must be closed. Once the device is in the water and floating, the user can be seated on the main panel 11 with the user's legs extending into the water. If the user wishes to get out of the floatation device, without carrying it onto shore, the door 30 provides an easy egress (or access) from the opening 25. The door 30 is designed to fit snugly into the side panel 20 to form a continuous panel for the side of the float. The central channel 24 between side panels 20 and 15 accommodates the user who is standing in the opening 25.

Figure 3:
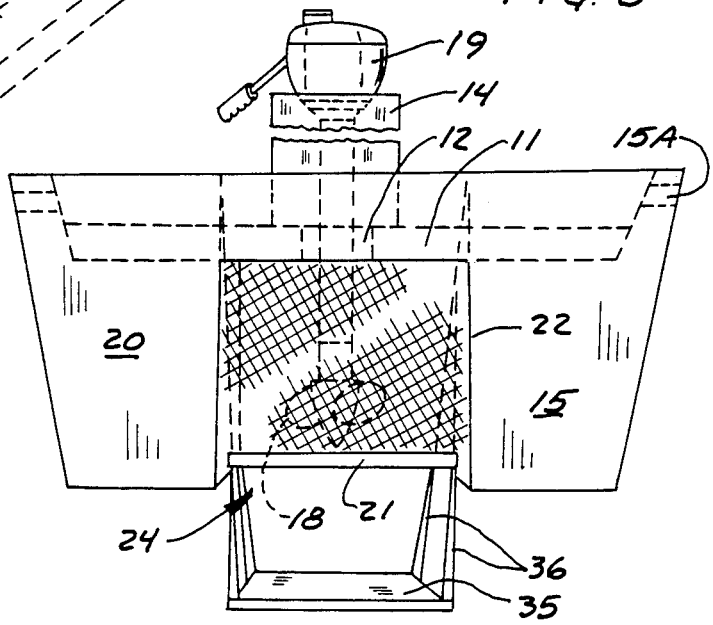
FIG. 3 is a front elevational view of the device of FIG. 1.
Figure 4:
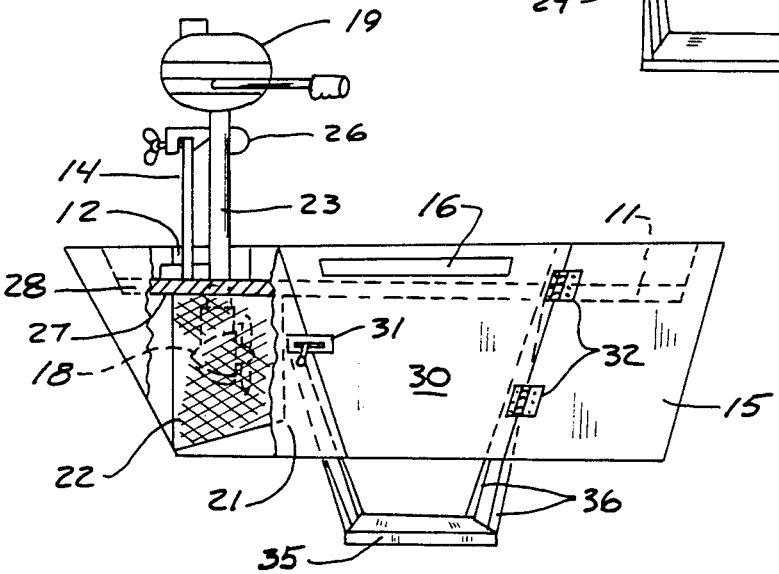
FIG. 4 is a side elevational view with a cutaway view of the device of FIG. 1.
Figure 5:
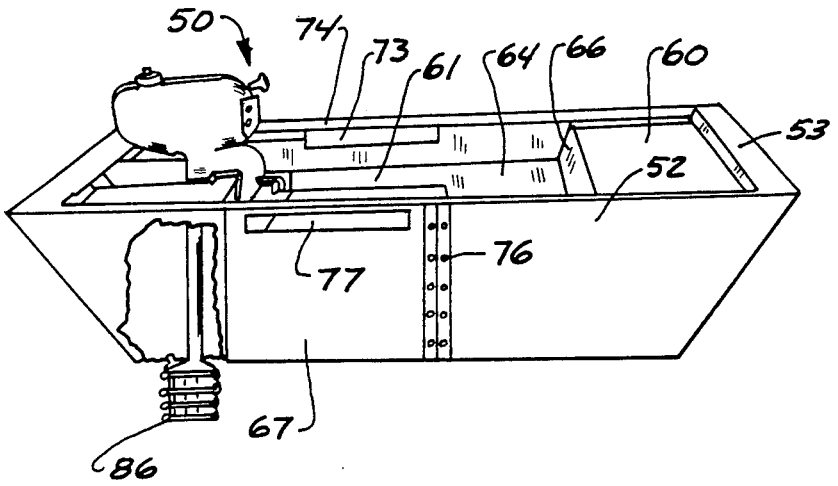
FIG. 5 is a perspective view of a modified form of the invention showing an optimal motor installed thereon.

The personal floatation device is adapted to be used with a small outboard motor 19, which has a motor shaft 23 and propeller 18. As best seen in FIGS. 3 and 4, a support board 14 is fixed to panel 11 adjacent a hole 12. The hole 12 accommodates the motor shaft 23 while the support board 14 supports the motor 19 using a clamp 26 to hold the motor fixed to the support board 14. The motor shaft 23 and propeller 18 extend below the main panel 11 and into the channel 24 ahead of the user.

A protective screen 22 is stretched between side panels 15 and 20 and supported thereon between the propeller 18 and the user's feet to protect the user's feet from the propeller. A footrest bar 21 is supported between the side panels 15 and 20 and extends across central channel 24 to provide a lower support for the protective screen 22 as well as a footrest. The protective screen 22 extends between the footrest bar 21 and the main panel of the personal floatation device 10. This protective screen 22 is thus supported between the user in opening 25 and the propeller 18, to protect the user from the propeller if a motor is used on the floatation device.

Figure 2:
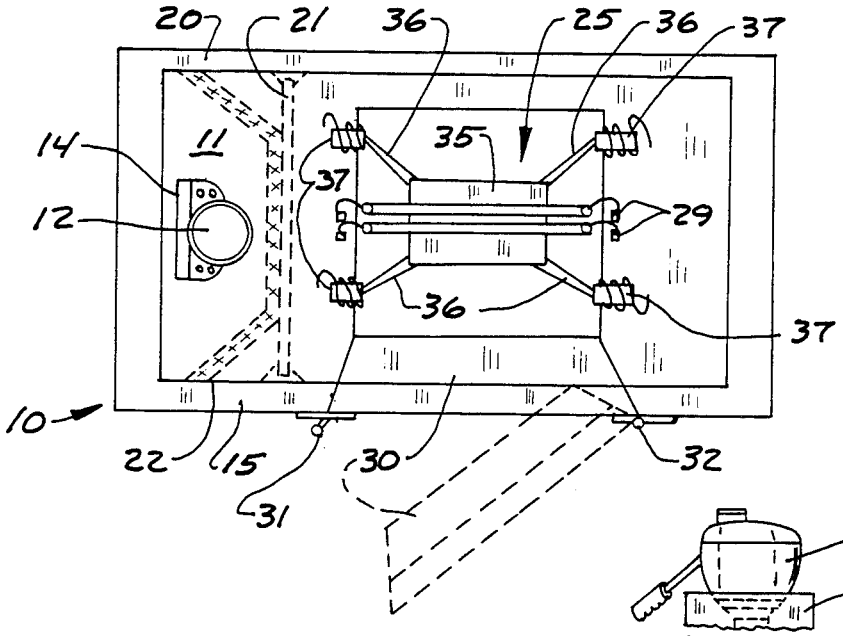
FIG. 2 is a top plan view of the device of FIG. 1.

In FIG. 2, safety straps 29 are shown. These safety straps 29 are removably connected with hooks across the opening 25 and are positioned to be between the legs of a user. These safety straps are to assure that the user in the opening 25 does not slide through inadvertently while seated on the main panel 11. If the user suddenly enters deeper water while seated on the main panel 11 and slides off the seat, the safety straps 29 will stop the user from sliding all the way through the central opening 25 which could be dangerous.

Referring to FIG. 3, a hanging footrest 35 hangs below the main body of the personal floatation device 10 and is connected to main panel 11 by ropes 36. This footrest 35 can be moved to the side when the user is walking with the floatation device 10 around the waist of the user. This hanging footrest 35 is to be used when the personal floatation device is floating in deeper water and the user is seated on the panel 11. The hanging footrest is adjustably attached to the main panel of the personal floatation device by ropes 36 which are attached on rope cleats 37. Because the hanging footrest is adjustable, the user can adjust the ropes to hold the footrest at a comfortable level. The rope cleats 37 are designed so the ropes can be easily tightened or loosened and are adjusted like other nautical rope cleats. The footrest bar 21 provides an alternate footrest from the adjustable footrest 35.

The personal floatation device 10 is constructed from a buoyant material such as styrofoam (foamed polystyrene). As best seen in FIG. 4 at the cutaway view, the styrofoam core 28 is surrounded by an aluminum skin 27 to provide a durable yet lightweight personal floatation device. Adhesives can be used for joining the components together.

While this embodiment has shown a motor 19 to be used to propel the personal floatation device, a sail or oars can be used just as easily. The sail mast can be supported at opening 12 on a suitable support, such as support 14. When sailing the footrest 35 would be adjusted to be deep and the footrest and the legs of the person act as a daggerboard or "keel" for sailing.

Also, the footrest can be designed to have foot paddles for propulsion if desired.

The main panel 11 can have inflated tubes or pontoons as means along the sides to provide floatation. The panel 11 will provide a place for a person to sit, and an access door can be provided if desired. A portion of the panel 11 can form the door, and the inflated pontoon could be compartmented or sectioned to form the door as well.

As shown in FIGS. 5 through 13, a modified personal floatation device or boat made according to the present invention is shown which is constructed substantially similarly to the previous form of the invention. In this form of the invention, the boat indicated generally at 50 is again a personal floatation device that is made to provide individual support for a person and includes an outer top frame that has first sidewall top member 51, a second sidewall top member 52, and a rear top member 53. A front top frame portion 54 is used to tie together two pontoon-like float structures 56, 56 which are spaced apart to form a central channel 57. The two pontoon-like members 56, 56 are also joined together with an upright frame cross wall 58. The top sidewall members 51 and 52 are joined to the pontoons or floats. A rear cross floatation block member 60 is joined to a first side floatation block portion 61, and a door floatation block portion 62 that are integral and form rear parts of the respective pontoon members 56.

Figure 7:
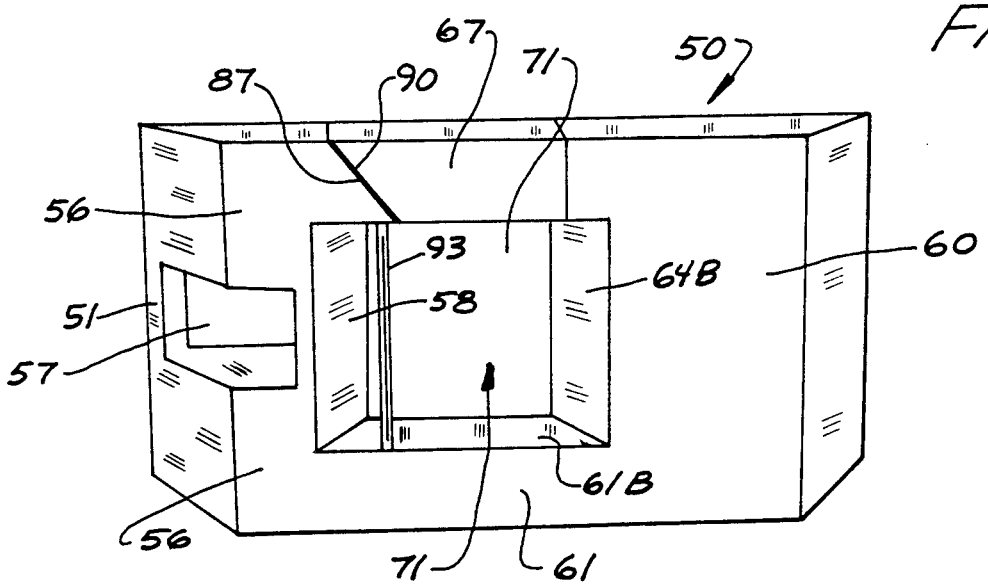
FIG. 7 is a bottom plan view of the boat of FIG. 5.
Figure 8:
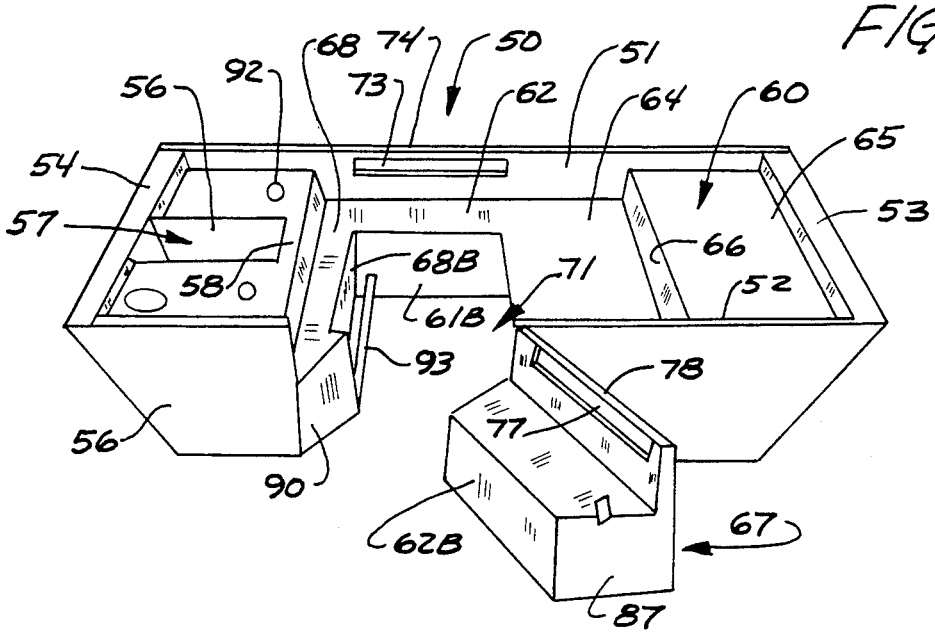
FIG. 8 is a perspective view showing an access door in an open position.
Figure 9:
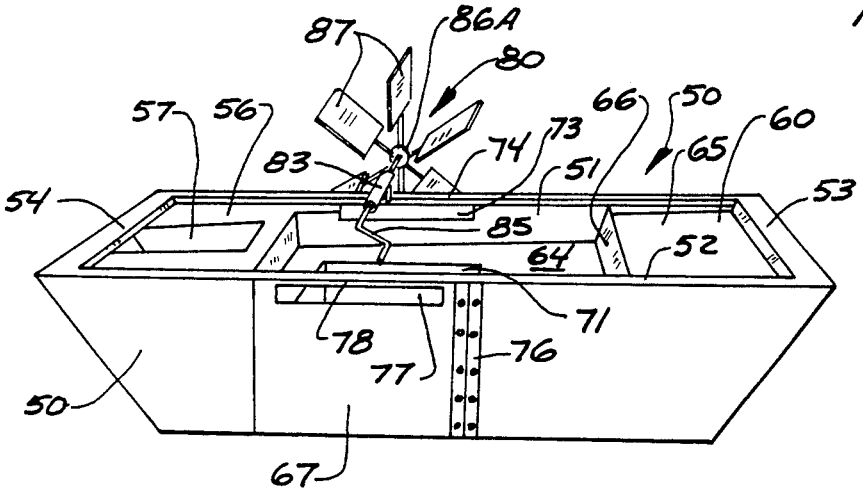
FIG. 9 is a side elevational view of the boat of FIG. 5 with a paddlewheel in place.
Figure 10:
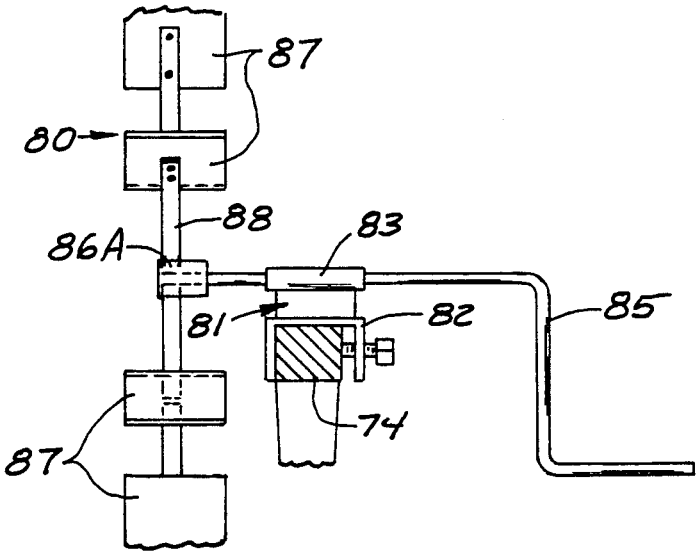
FIG. 10 is a sectional view looking rearwardly immediately ahead of the paddlewheel of FIG. 9.

The rear cross-floatation block 60 can be a styrofoam block, that has a flat bottom as shown in FIG. 7 and which extend continuously between the sides of the boat. The pontoon members 56, 56 also have flat bottom surfaces. The styrofoam has a shell or cover layer of aluminum or fiberglass thereon.

The rear cross-block 60 forms a main cross panel that has a seat surface portion 64 which is reduced in height from an upper surface 65 of the cross-block or panel to form a back support surface 66 that extends all the way across the boat. The top surface of the floatation blocks 61 and 62 are at the same level as the seat surface 64. There is a ledge shown at 68 that extends rearwardly from and along the wall 58 at this same level as well. The block 62 is formed into a door 67 that can be opened and closed.

The block portion 61 of the float or pontoon provides a width of the sidewall in transverse direction that is substantial, (for example 7½ inches or so) and is joined with the cross floatation block 60, and to the cross member 58 so that the wall of the float block portion 61 provides rigidity for the boat when door 67 is opened, which disconnects the rear portion of the boat from the front at the left sidewall.

Figure 6:
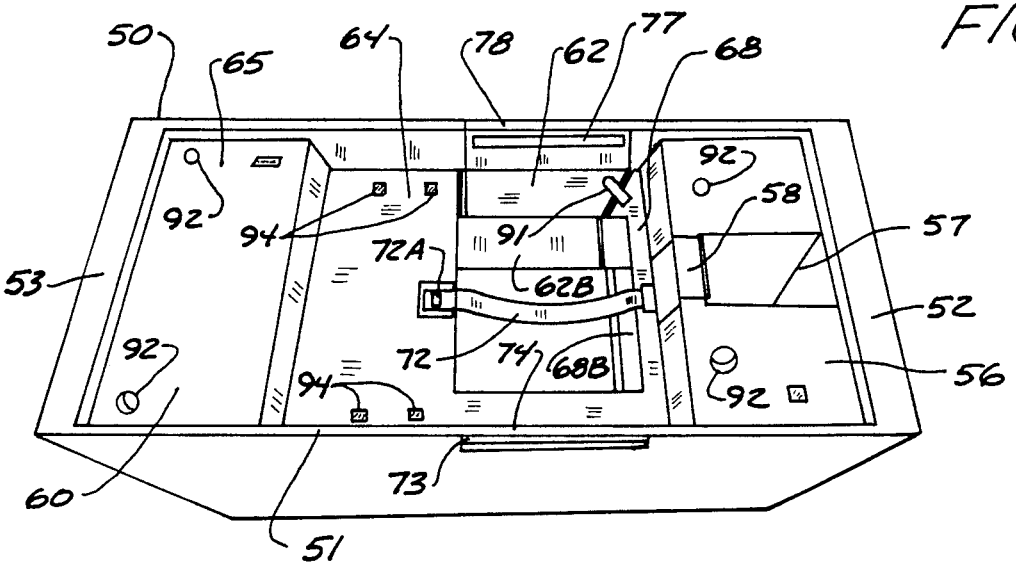
FIG. 6 is a top perspective view of the boat of FIG. 5 with it rotated end for end.

As can be seen in FIGS. 6 and 7, the float block portion 61 and the float block portion 62 together define the sides of central opening 71, along with the front surface 64B of the seat 64 and surface 68B of ledge 68, along with member 58. A safety strap 72, which is much like a seat belt, can be releasably fastened between the seat surface 64 and the ledge 68 for providing a safety support when it is straddled by a user. This can be released easily when it is in the way with a standard seat belt latch 72A for moving the unit while walking.

The side wall portion 51 extends upwardly from the upper surface 61A of the float block portion 61 and a recess or opening 73 is formed in the upper portion of wall 51, with a top frame member 74 over the opening. The frame member 74 is made to have sufficient structural strength to act as a handle and to permit mounting a paddlewheel assembly 75 thereon. The handle frame member can have a central tube or structural member covered with foam or fiberglass.

The door 67, as shown, is supported with a hinge 76 relative to the rear portion of the boat, so that the door can swing open and permit access to the central opening 71. The sidewall top portion 52 on the door 67 has a recess 77 at the top, with a frame member 78 over the recess to form a handle and paddle wheel assembly. A paddle wheel assembly 80 is shown on this side of the boat in FIG. 6. Each of the paddle wheel assemblies is supported with a paddle wheel mounting hub 81 that clamps with a suitable clamp 82 to the respective frame member 74 and 78, and the support hub 81 has a bushing sleeve 83 thereon that rotatably mounts a crank shaft 84. The crank shaft 84 has a crank end 85 on the interior of the floatation device or boat, and the outer end has a hub 86A which mounts a plurality of paddles 87 on suitable paddle supports 88. The number of paddles 87 can be varied as desired, but it can be seen that by rotating the crank the person in the boat can cause the paddlewheels to rotate and propel the boat slowly through the water. The paddles, of course, are selected in length and positioned so that they will engage the water when a person of normal weight is seated on the seat surface 64. This permits turning and gently moving the floatation device or boat while fishing, and will permit quick turns by rotating one paddle in each direction. The paddle assemblies are removably clamped with clamps 82, so that they can be removed and the boat used without them. For example, a small sail can be mounted on the boat.

It should be noted that the handles or top frame members 74 and 78 are elongated in front to rear direction, which makes it easy for a person to get the right center of gravity for lifting the boat when moving it in water that is knee deep or sufficiently shallow for the person to stand and still lift the boat for moving it.

The pontoons 56, including the block portions 61 and 62, and the cross float block 60 can be molded as one unit of foam that has an outer skin or covering of aluminum or fiberglass. A shell that includes outer walls or skin and inner walls can be used and material can be foamed in place in the shell to provide structural strength if desired. The other parts can be formed integrally or secured with adhesive as desired.

An outboard motor indicated at 85 can be mounted on the cross-wall 58, with the motor ahead of the cross-wall 58 and between the pontoons. To protect the operator or person seated on the seat surface 64, a screen member 86A that is mounted directly to the motor can be used for protection against injury from the propeller.

As can be seen in the top view of FIG. 6, the door 67 has the thick block portion 62 (7½ inches or so) as part thereof, and a forward end cut surface is at an angle, as indicated at 87, to insure that the door will have clearance to swing open. The ledge 68 is at the juncture of the door separation, and the forward portion of the float has a mating cut as shown along the surface 90. A latch that can be tightened, such as an overcenter clamp is indicated at 91 on the upper surface of block portion 62 and of the ledge 68, to tighten the door and front pontoon portion together across the surfaces 87 and 90 and rigidly hold the boat in an assembly when the door is closed.

The upper portions of both pontoons 56 can have tubular openings indicated at 92 for holding fishing poles, in suitable locations, and velcro hook and loop fastener strips indicated at 93 can be applied to the surfaces of the seat 64 along the side edges, and also to the top surface of the pontoons 56 for holding a tackle box and other equipment that would have a mating portion of the hook and loop fastener. They also can be used for holding lures individually.

It should be noted that the front and rear ends of the boat 50 are cut at an angle with respect to the vertical so that the boat can be propelled in either direction, and while the boat is a flat bottom unit as can be seen in FIG. 7, it can be moved adequately for the needs of a person who is fishing. Also, in FIG. 9, a cross rod 93 is provided as a foot support.

In FIGS. 11 through 13, there is a modified form of a paddlewheel drive illustrated. This is a foot operated paddlewheel that can be operated to provide rotation of the paddlewheels in either direction by downward pushes with the foot. The paddlewheels would be mounted on both sides of the boat, including the door side. As shown typically, a paddlewheel assembly 100 includes a mounting bracket 101 that provides for a bearing 102A for rotatably mounting a shaft journal 102 of a shaft end that drivably supports a paddlewheel 103 on the exterior of the boat. The shaft journal 102 is part of a crankshaft 104 that has a hand drive loop 105 that is bent out of the axis of rotation. The loop has a second crank shaft journal 106 that is mounted in a suitable bearing on the top of an upright support channel 107. The journal 106 has the same central axis as the journal 102, so the crank member 104 will rotate, and the paddlewheel 103 can be rotated on the bearings 102A and 106A that support the crank journals. A crank arm 108 is provided to drive the crankshaft assembly, and is fixed to the exterior end of the journal 106 and clears the support 107. The support 107 is a channel-shaped member having bent over lips, as can be seen in FIG. 12. The support 107 is fastened to the inner surface 61B of the block portion 61, and the surface 62B of the door block 62. The channel-shaped support 107 has a slider block slidably mounted therein as indicated at 112. This block 112 is slidably retained in place by the flange portions 107A, 107A in the channel-shaped support member 107. The block 112 then can slide up and down on the support 107. Block 112 supports a pivot pin indicated at 113. The pivot pin 113 in turn pivotally mounts an actuator link or lever 114. The actuator lever 114 is pivotally mounted with a suitable crank pin 116 to the crank arm 108 at the outer or upper end of the lever 114, and has a foot peg 120 at the lower end, with an overlying stirrup strap 121 that would go over the top of the foot of a person operating the unit.

The support 107 has a spring retainer rod 122 fixed to extend forwardly therefrom near the upper end of support 107. A tension spring 123 of suitable strength has one end connected to rod 122, which in turn is attached to a spring support rod 124 that is fixed to the lower portions of pivoting actuator lever 114.

The spring 123 is made such that it will always pull the actuating lever 114 and slide block 112 to an up position with the crank arm 108 above a horizontal plane. The up position can be adjusted at least sightly by changing spring length. When the lever 114 is pivoted on pin 113 so that the foot peg 120 is forwardly, and the upper end of lever 114 and pivot pin 116 are rearwardly, as shown in FIG. 11, a downward stroke on the foot peg 120 will cause the paddle to rotate in a clockwise direction, as shown in FIG. 11, and indicated by the arrow 128. When the actuator link 114 is pivoted about pin 113 so that the upper end and pin 116 are forwardly of the shaft journals and thus the crank arm 108 is forwardly, which can be done by manipulating the feet, and the foot peg is then depressed downwardly, the paddle shown will then move in a counterclockwise direction and propel the boat forwardly.

The drive crank shafts 104 are made so that they can be continuously operated with the foot pegs, by moving the pegs and levers 114 back and forth and up and down. The up movement is provided by spring 123 and power would be on the down stroke with the spring up return 123. This will permit movements for fishing purposes without using the hand cranks. As shown, however, the hand crank portion 105 can be utilized to rotate the crankshaft 104.

The slide block 112 permits the up and down movement, while the pivotal movement on the pin 113 of the actuator lever or link 114 permits selection of direction and continuous rotation operation. The pin 113 is positioned on the lever so the front and rear movement of the foot pegs is small. The hand crank loops may be used to assist in keeping the paddle wheels moving.

The boat is lightweight, and is structurally sound even when the door is opened. Because of the depth and width of the block portion 61, tendency of the front section to rack relative to the rear section is reduced.

Further, the seat back surface 66 prevents the operator from sliding too far back and causing unbalance or rearward tipping of the floatation device. Also, the cross-member block 60 is very thick vertically, to provide for rigidity and strength when the door is opened. Typically, the top of the boat would be about six feet long and just under three feet wide. The center opening could be about 20 inches square. The handles are about 16 inches long and the door is about 20 inches long at the outside. The seat 64 and surface 65 are about 14 inches in fore and aft direction.

The device is lightweight and small, thus helpful for things in addition to fishing, such as physical therapy where a person is learning to reuse muscles in the legs and the like can be safely in a pool and provide for mild exercise. It also can be used for duck hunting, moving along a shore for finding shells, rocks or other artifacts, or just for recreation and playing.

Accessories can be mounted as shown, including the paddlewheel drive.

Although the present invention has been described with reference to preferred embodiments, workers skilled in the art will recognize that changes may be made in form and detail without departing from the spirit and scope of the invention.

What is claimed is:

1. A portable personal floatation device comprising a floating boat structure having a pair of spaced apart sides, and front and rear ends, cross panels between the sides adjacent to the front and rear ends at a first level immediately below upper edges of the sides, a seat member formed in said personal floatation device below the first level in the center portions of the personal floatation device and spaced from both the front and rear ends a selected amount, and an opening having access from a door formed on one of the sides, the opening defined in the personal floatation device for an operator's legs to extend therethrough while seated on the seat portion, the seat portion being adjacent to the rear end of the personal floatation device.

2. The portable personal floatation device of claim 1 wherein the door is formed from a laterally thick block, a first edge of said door being hingedly attached to other portions of the one side, and having a substantial lateral thickness, the door having an upright second edge surface which is unhinged and which is cut at an angle to provide clearance for opening the door outwardly to permit access to the opening defined in the portable personal floatation device.

3. The portable personal floatation device of claim 2 and a pair of elongated hand grip members formed on each of the sides adjacent to the upper edges thereof, formed by recesses in the side walls and an elongated grip member overlying the recesses, said elongated grip member being graspable by a user and permitting the user to obtain a balance point in longitudinal direction of the portable personal floatation device.

4. The portable personal floatation device of claim 1 and the means on upwardly facing surfaces of the device for attaching fishing gear.

5. A portable personal floatation device of claim 4 and recesses formed in said upper surfaces for retaining the handles of fishing poles therein.

6. The portable personal floatation device of claim 1 wherein said floatation device has a block extending between the sides to the rear of the opening defined therein, and a pair of spaced apart pontoon members at a forward portion of the floatation device and extending along opposite lateral sides of the opening, said pontoon members being joined by an upright wall rearwardly of the front of the floatation device, said upright wall member being formed at a top portion thereof to provide a support for an outboard motor between the pontoon members forwardly of the upright wall.

7. The portable personal floatation device of claim 1 wherein said floatation device contains a bottom wall extending between the sides to the rear of the opening defined therein, and a pair of spaced apart pontoon members extending toward the front from a front edge of the bottom wall, the front edge of the bottom wall defining a rear edge of the opening, said pontoon members forming floatation members at the sides of the floatation device and having pontoons along lateral sides of said opening.

8. A floatation structure housing a top transverse seat surface, longitudinally extending sides, a front end and a rear end, an opening defined in the structure of size to permit a person to extend through the opening, said opening being defined by elongated side float block panels along the sides thereof, the float blocks having a vertical height with a top and bottom edge; a door formed in a portion of one float block, and the door defining one side of the opening in the structure, the door extending between a top and bottom of the one float block and being positioned between the front and rear ends of the structure; and the seat surface having sufficient space for a person to sit thereon with legs through the opening.

* * * * *